US007356891B2

(12) United States Patent
Freeman

(10) Patent No.: US 7,356,891 B2
(45) Date of Patent: Apr. 15, 2008

(54) CONCEALED PANEL LOCKING MECHANISM

(76) Inventor: William D. Freeman, 13815 Kleberg Rd., Dallas, TX (US) 75253

( * ) Notice: Subject to any disclaimer, the term of this patent is extended or adjusted under 35 U.S.C. 154(b) by 322 days.

(21) Appl. No.: 11/186,672

(22) Filed: Jul. 21, 2005

(65) Prior Publication Data

US 2007/0033885 A1 Feb. 15, 2007

(51) Int. Cl.
*A61G 17/00* (2006.01)

(52) U.S. Cl. ..... 27/35; 52/134; 52/136; 70/166; 292/251.5

(58) Field of Classification Search ..... 27/1, 27/35; 52/134, 136, 139; 70/163, 166–173, 70/276; 292/184, 189, 251.5
See application file for complete search history.

(56) References Cited

U.S. PATENT DOCUMENTS 2,618,145 A * 11/1952 Sinner et al. ..... 52/509
3,736,779 A * 6/1973 Pratt ..... 70/276
3,754,805 A * 8/1973 Pangburn et al. ..... 312/111
3,841,726 A * 10/1974 Andos et al. ..... 312/111
4,607,417 A * 8/1986 Hancovsky ..... 27/1
4,614,066 A * 9/1986 Koppenberg ..... 52/134
5,287,603 A 2/1994 Schorman
5,477,594 A * 12/1995 LePage ..... 27/1
6,167,600 B1 * 1/2001 Williams et al. ..... 27/1
6,513,352 B1 * 2/2003 Mainville ..... 70/166
6,578,323 B1 * 6/2003 Zartman et al. ..... 52/134

* cited by examiner

*Primary Examiner*—William L. Miller
(74) *Attorney, Agent, or Firm*—Stephen J. Walder, Jr.

(57) ABSTRACT

A concealed panel locking mechanism is provided which may be used to secure the contents of a container in a manner that is not discernable to an uninformed individual viewing the container. In one exemplary embodiment, the locking mechanism includes one or more channels formed into a central area of a panel of material. A locking member within the one or more channels is movable along the channel to either engage or disengage the locking member from a recess formed in a side wall of the container. In one embodiment, the locking member is not physically accessible from outside the channel by a human being but is formed from a ferromagnetic material that is moved within the channel by a magnetic force generated by a suitable strength magnetic key placed on the outside surface of the panel.

20 Claims, 3 Drawing Sheets

CONCEALED PANEL LOCKING MECHANISM

BACKGROUND OF THE INVENTION

1. Technical Field

The present invention is generally directed to a concealed panel lock. More specifically, the present invention is directed to a concealed panel lock for locking a panel cover to a structure representing a concealed compartment. In one exemplary embodiment, the present invention provides a concealed panel lock for locking a panel cover of a columbarium to a columbarium niche.

2. Description of Related Art

Columbaria are memorial structures having a plurality of niches in which one or more urns may be placed for inurement. Columbaria may be found, for example, in churches and cemeteries and serve as the last resting place for the remains of cremated persons and animals. FIGS. 1 and 2 are examples of known columbarium structures.

As shown in FIG. 1, the columbarium 100 includes a plurality of niches 110 which are compartments within the columbarium structure. The niches 110 are typically sized to permit the storage of one or more urns, i.e. containers in which the ashes or cremated individuals or animals are placed. Often the niches 110 are sized for the storage of two urns in order to permit the remains of spouses to be inurned with each other when both spouses die.

Because spouses often do not die at the same time, and other reasons, columbaria are structured to allow access to the niches after inurement of the remains of the individuals. The known methods for permitting access to the niches include having a single panel that covers all of the niches and individual panels for each niche that are secured by external screw type fasteners. FIG. 1 illustrates the single panel configuration in which the single panel is referenced as 120. FIG. 2 illustrates the individual panel configuration in which the individual panels are referenced as 220.

As shown in FIG. 1 a single panel 120 may be placed over top of all of the niches 110 in order to enclose the niches 110. The single panel 120 may be slid into place using grooves formed in the columbarium structure 100 and locked in place using some securing mechanism (not shown). The single panel 120 is scored to give the illusion of separate niches, however the panel 120 is a single piece covering all of the niches.

The configuration of the columbarium has a number of disadvantages. First, because the panel 120 is a single piece, in order to gain access to an individual niche 110, the entire panel 120 must be removed, thereby exposing the contents of the other niches. This is especially a problem when the remains of an individual or animal are being inurned in a columbarium structure that already contains the remains of other individuals or animals in other niches. In order to respect the remains of the other individuals or animals, a curtain must be erected to cover the contents of the other niches during the inurement ceremony. This requires additional setup time and cost in performing the inurement ceremony as well as being less desirable visually to loved ones attending the inurement ceremony.

Second, if the panel 120 provides space for the engraving of information, such as the deceased's name and an epitaph, it is necessary to remove the entire panel 120 and place the entire panel 120 in the engraving machinery. This is very unwieldy and causes extra burden on those performing the engraving of the panel 120.

In addition, because of the size of the panel 120, it is often formed from a lower cost and less weighty material than the rest of the columbarium structure. In other words, in order to make the panel 120 removable, the panel 120 is often formed from a plastic material that is lower in weight than the marble used to fashion the columbarium structure 100. This is not as aesthetically pleasing to those who come to give their respect to the remains of the deceased and is not as reverent as if a marble material were used. However, the size of the panel 120 makes it unrealistic to make the panel 120 out of as heavy a material as marble or granite.

FIG. 2 illustrates the other typical configuration of columbaria in which individual panels 220 are provided for each niche 210. Since each niche 210 has its own panel 210 to enclose the niche 210, each panel must be individually sealed. This is typically done by way of ornamental screw type fastener structures 230. These ornamental screw type fastener structures 230 may be provided, for example, as rosettes in which the center of the rosettes is a screw that passes through the corner of the panel 220 and secures the panel 220 to the columbarium structure 200.

While this columbarium structure avoids the problems of weight, cost and size of the single panel configuration, the securing mechanism is made accessible to individuals that may not be authorized to access the contents of the niches 210. That is, because the screw fasteners are accessible from the front of the columbarium, it is possible for persons to unfasten the panels 220 from the niches 210 in order to gain access to the contents of the niches. In addition, the fastener mechanisms are clearly visible to those paying their respects to the remains of those inurned in the columbarium.

Thus, it would be beneficial to have an apparatus for securing a panel cover to a compartment in such a manner that permits individual panels per compartment and such that the securing mechanism is not readily identifiable or easily accessible from outside the compartment.

SUMMARY OF THE INVENTION

The present invention provides a concealed panel locking mechanism which may be used to secure the contents of a container in a manner that is not discernable to an uninformed individual viewing the container. In one exemplary embodiment, the locking mechanism includes one or more channels formed into a central area of a panel of material. These one or more channels are not identifiable by a viewer of the panel looking at the panel from either of the flat planar sides and are only perceivable as a slot when the panel is viewed from an edge.

A locking member within the one or more channels is movable along the channel to either engage or disengage the locking member from a recess formed in a side wall of the container. When the locking member engages the recess formed in the side wall of the container, the panel is secured to the side wall and thereby forms a secured container. When the locking member is disengaged from the recess in the side wall of the container, the panel is removable in order to access the contents of the container.

In a preferred embodiment, the locking member is not physically accessible from outside the channel by a human being. That is, there are no mechanisms physically present on the panel that permit the movement of the locking member within the channel, e.g., no levers, sliding mechanisms, etc. To the contrary, in a preferred embodiment, the locking member is formed from a ferromagnetic material that is moved within the channel by a magnetic force generated by a suitable strength magnetic key, such as a key fashioned from rare earth magnetic materials, e.g., Neodymium Iron Boron (NdFeB), placed on the outside (i.e. outside the container) surface of the panel. The magnetic key magnetically attracts the ferromagnetic locking member and permits a person to slide the magnetic key along the outside surface of the panel to engage or disengage the ferromagnetic locking member from the recess formed in the side wall of the container. The magnetic key is preferably of a type, and the ferromagnetic material is of a magnetic strength, where ordinary every day use magnets do not generate a sufficient magnetic field to engage and disengage the ferromagnetic locking member. To the contrary, the magnetic material of the magnetic key is preferably of a type that is relatively more difficult and more expensive to obtain for the average person in order to avoid permitting anyone with a low strength magnet from accessing the container's contents.

In one exemplary embodiment, the channel is formed as a curved channel that initially curves downward and then runs horizontally when the panel is placed in proper position on the container, i.e. substantially vertical relative to a horizontal plane. In such an embodiment, the ferromagnetic locking member is formed as a disc within the channel. In this way, when the magnetic key is not in place on the outside surface of the panel, the force of gravity causes the ferromagnetic disc to roll down the curved channel and its momentum causes it to continue to roll along the horizontal portion of the channel to a position where the ferromagnetic disc engages the recess in the sidewall of the container.

When engaged, the locking member is partially positioned within the recess of the side wall of the container and partially within the channel of the panel. In this way, a person attempting to remove the panel cannot remove the panel due to the locking member barring the removal of the panel. The locking member is preferably fashioned from a material that has sufficient strength to withstand most attempts at removing the panel from the container. Such materials may include, for example, iron, ferro-magnetic ceramics, aluminum, stainless steel, hard plastics, and the like. In short, any strong material having either magnetic or non-magnetic properties may be used without departing from the spirit and scope of the present invention.

In one preferred embodiment of the present invention, the container is a niche of a columbarium that is used to store the cremated remains of a deceased individual or animal. Typically, for human remains, columbaria are constructed with niches having sufficient capacity to store the remains of two individuals, e.g., husband and wife. Since most individuals do not pass away at the same time, it is important to be able to access the niche after placement of one spouse's remains within the niche in order to inurn the second spouse's remains once the second spouse dies. As a result, the columbarium niche according to the present invention is provided with a concealed ferromagnetic locking mechanism that permits the panel covering the niche to be secured after placement of the remains of a first deceased spouse. Once the other spouse passes away, the ferromagnetic locking mechanism of the present invention may be disengaged so that the contents of the niche may be accessed again. In this way, the remains of the second spouse may be added to the remains of the first spouse.

Thereafter, the ferromagnetic locking mechanism may be removed from the panel and replaced with a similar non-ferromagnetic locking mechanism. Once the panel is put into place, the locking mechanism engages the recess formed in the side wall of the niche since there is nothing causing the locking mechanism to stay in a disengaged state. Since the non-ferromagnetic locking mechanism cannot be moved by a magnetic field and there is no other access to the locking mechanism from outside the niche, the use of the non-ferromagnetic locking mechanism essentially forms a permanent lock of the niche. Thus, when it is determined appropriate, the present invention permits a virtually permanent lock of the contents of the niche so that external access to the contents of the niche is prevented without great effort.

These and other features and advantages of the present invention will be described in, or will become apparent to those of ordinary skill in the art in view of, the following detailed description of the preferred embodiments.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE PREFERRED EMBODIMENTS

The present invention provides a concealed locking mechanism for a panel of a compartment in which objects may be stored. The locking mechanism of the present invention is concealed in that it is not discernable from outside the compartment when the panel is placed into position over an opening of the compartment. Furthermore, no mechanisms for unlocking the panel from the compartment are discernable from outside the compartment. In one exemplary embodiment, the compartment is a niche of a columbarium in which urns having the cremated remains of persons or animals may be stored.

Figure 1:
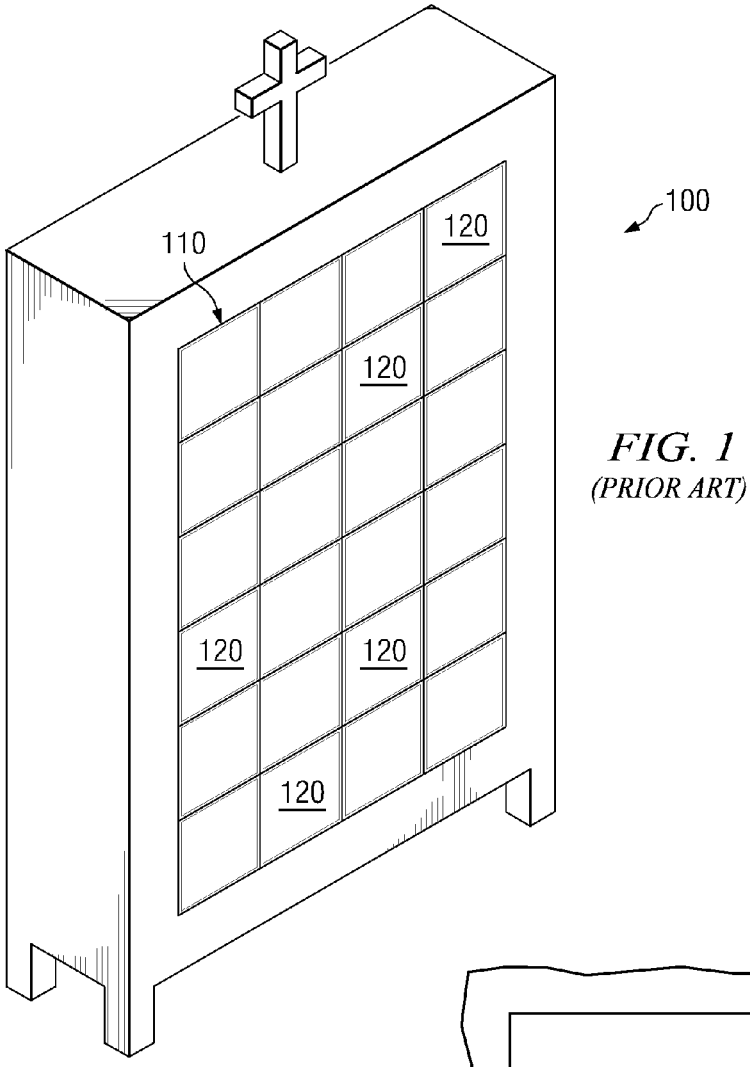
FIG. 1 (PRIOR ART)
FIG. 1 is a diagram illustrating one configuration of a known columbarium structure.
Figure 3:
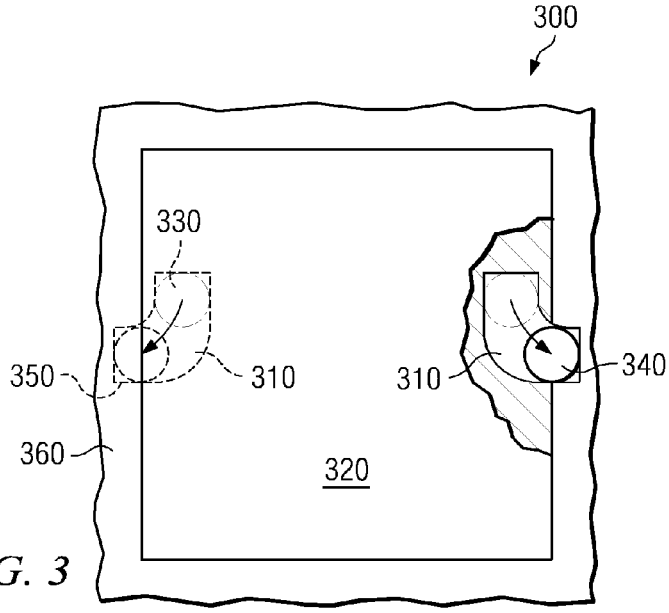
FIG. 3 is an exemplary diagram illustrating one exemplary embodiment of a concealed locking mechanism for a panel of a compartment.
Figure 2:
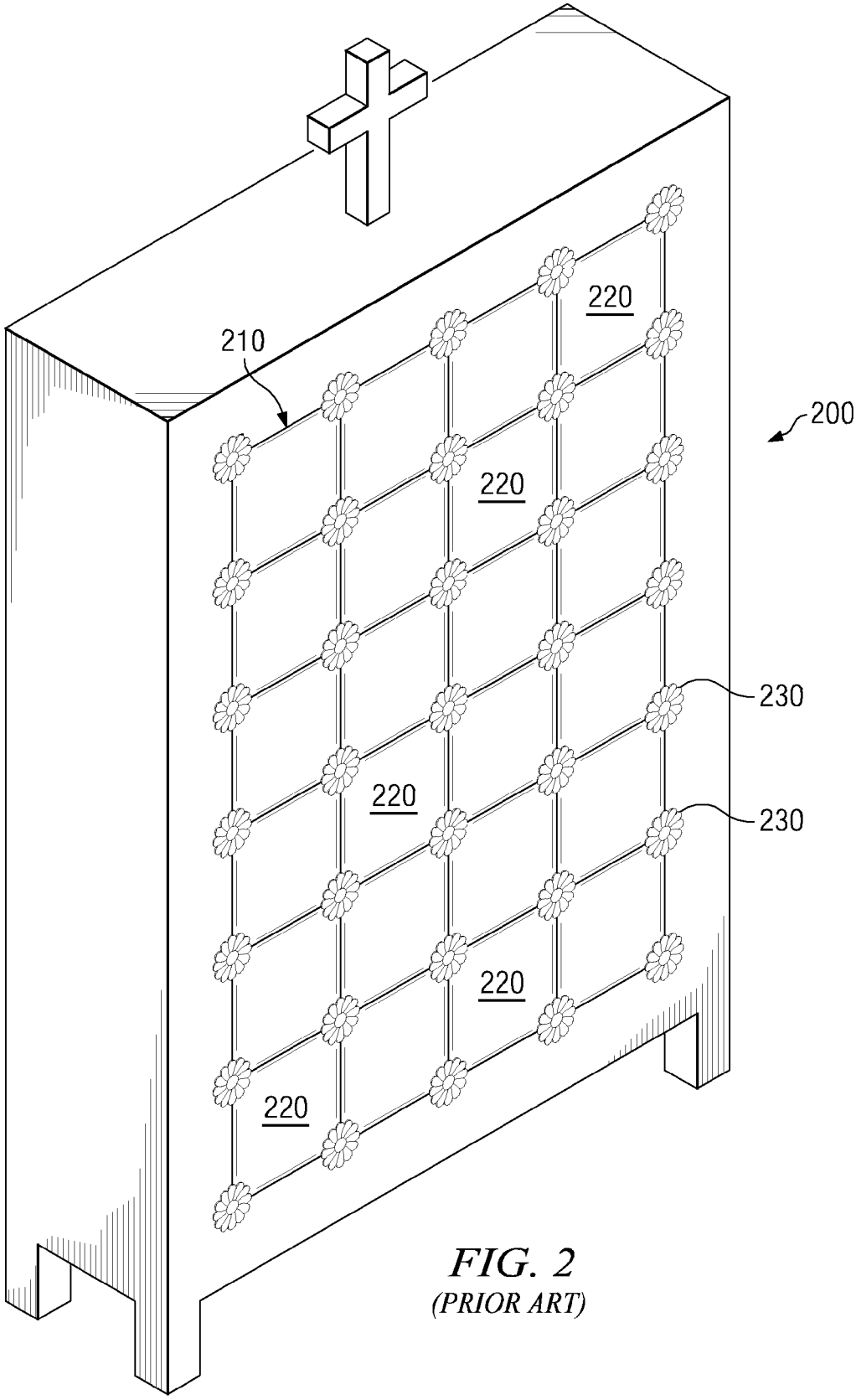
FIG. 2 (PRIOR ART)
FIG. 2 is a diagram illustrating a second configuration of a known columbarium structure.

FIG. 3 is an exemplary diagram illustrating one exemplary embodiment of a concealed locking mechanism for a panel of a compartment. As shown in FIG. 3, in one exemplary embodiment, the locking mechanism includes one or more channels 310 formed into a central area of a panel 320 of material. These one or more channels 310 are not identifiable by a viewer of the panel 320 looking at the panel 320 from either of the flat planar sides and are only perceivable as a slot when the panel 320 is viewed from an edge.

The channels 310 may take one different configurations depending upon the particular implementation of the present invention. As shown, the channels 310 are curved having both a vertical portion and a horizontal portion, however the present invention is not limited to any particular configuration of channel or orientation of the channels. For example, rather than using curved channels as depicted, a horizontal channel or angled channel, relative to a horizontal axis, may be utilized without departing from the spirit and scope of the present invention. FIG. 3 depicts one exemplary preferred embodiment in which curved channels are utilized for the reasons discussed hereafter.

A locking member 330, 340 within the one or more channels 310 is movable along the channel 310 to either engage or disengage the locking member 330, 340 from a recess 350 formed in a side wall 360 of the container or compartment 300. The locking member 330, 340 is shown as a circular disc in FIG. 3 but may take on various configurations depending upon the particular implementation of the present invention that is utilized. For example, in an embodiment where the channel is not curved, the locking member 330, 340 may be rectangular in shape. In a preferred embodiment, the locking member 330, 340 has a circular disc-type shape as shown for the reasons stated hereafter, however the present invention is not limited to such an embodiment.

When the locking member 330, 340 engages the recess 350 formed in the side wall 360 of the container or compartment 300, the panel 320 is secured to the side wall 360 and thereby forms a secured container or compartment 300. This is because the locking member 330, 340 is positioned such that a portion of the locking member 330, 340 is located within the recess 350 while another portion of the locking member 330, 340 is located within the channel 310 of the panel 320 and thus, the locking member 330, 340 spans the intersection of the panel 320 and the container/compartment side wall 360. If one were to attempt to remove the panel 320 when the locking member 330, 340 is so positioned, the locking member 330, 340 would encounter resistance from the side wall 360 and the panel 320 and would not allow either to moved.

When the locking member 330, 340 is disengaged from the recess 350 in the side wall 360 of the container/compartment 300, the panel 320 is removable in order to access the contents of the container/compartment 300. This is because the locking member 330, 340 no longer spans the intersection of the locking member 330, 340 and the side wall 360 and is entirely within the channel 310. As a result, there is nothing that would provide resistance when the panel 320 is moved from its position covering the opening of the container/compartment 300.

In a preferred embodiment, the locking member 330, 340 is not physically accessible from outside the channel 310 by a human being. That is, there are no mechanical or electrical mechanisms physically present on the panel 320 that permit the movement of the locking member 330, 340 within the channel 320, e.g., no levers, sliding mechanisms, etc. The locking member 330, 340 is only movable by way of a non-mechanical and non-electrical mechanism. In a preferred embodiment, this non-mechanical and non-electrical mechanism is a magnetic attractive force generated by a magnetic field of the locking member 330, 340 and a magnetic field of a mechanism placed in proximity to the locking member 330, 340 on the outside surface (i.e. outside the container/compartment 300) of the panel 320.

For example, the locking member 330, 340 may be formed from a ferromagnetic material. As a result, the locking member 330, 340 may be moved within the channel 310 by applying a magnetic force generated by a suitable strength magnetic key, such as magnetic key 490 in FIGS. 4A and 4B, described hereafter. The magnetic key may be placed on the outside surface of the panel 320 (i.e. outside the container/compartment 300) in relatively close proximity to the ferromagnetic locking member 330, 340. The magnetic key magnetically attracts the ferromagnetic locking member 330, 340 and permits a person to slide the magnetic key along the outside surface of the panel 320 to thereby move the locking member 330, 340 along the path defined by the channel 310. In this way, the locking member 330, 340 may be engaged or disengaged from the recess 350 formed in the side wall 360 of the container/compartment 300.

The magnetic key is preferably of a type, and the ferromagnetic material is of a magnetic strength, where ordinary every day use magnets do not generate a sufficient magnetic field to engage and disengage the ferromagnetic locking member 330, 340. To the contrary, the magnetic material of the magnetic key is preferably of a type that is relatively more difficult and more expensive to obtain for the average person in order to avoid permitting anyone with a low strength magnet from accessing the container/compartment's contents. For example, in one preferred embodiment of the present invention, the magnetic key is formed from a rare earth magnetic material, e.g., Neodymium Iron Boron (NdFeB), which generates a strong magnetic field.

The need for a strong magnetic field may further be emphasized by the particular materials used to create the panel 320 and the container/compartment 300. For example, if the panel 320 and container/compartment 300 are fashioned from a stone material, such as marble, granite, or the like, a thickness of the material and the density of the material may make it necessary for the magnetic field to have sufficient strength to penetrate the material of the panel 320 and/or the container/compartment 300 to attract the locking member 330, 340.

As touched upon above, in one preferred embodiment, the channel 310 is formed as a curved channel that curves downward and then runs horizontally when the panel 320 is placed in proper position over an opening in the container/compartment 300, i.e. substantially vertical relative to a horizontal plane. That is, in preferred embodiments, the container/compartment 300 is configured such that the opening of the container/compartment is along a vertical plane relative to a horizontal plane of the earth. Therefore, when the panel 320 is placed into position, it is substantially vertical in orientation. Examples of such vertically oriented container/compartments 300 include container/compartments formed in walls of a building, cabinets, niches in columbaria, and the like. Although the depicted preferred embodiment is for a vertically oriented container/compartment 300, the present invention is not limited to such and any container/compartment may utilize the present invention without departing from the spirit and scope of the present invention.

In such a vertically oriented embodiment, the ferromagnetic locking member 330, 340 is formed as a disc within the channel 310. In this way, when the magnetic key is not in place on the outside surface of the panel 320, the force of gravity causes the ferromagnetic disc locking member 330, 340 to roll down the curved channel 310 and its momentum causes it to continue to roll along the horizontal portion of the channel 310 to a position where the ferromagnetic disc engages the recess 350 in the sidewall 360 of the container 300.

When engaged, the locking member 330, 340 is partially positioned within the recess 350 of the side wall 360 of the container 300 and partially within the channel 310 of the panel 320. In this way, a person attempting to remove the panel 320 will not be able to do so due to the locking member 330, 340 barring the removal of the panel 320. The locking member 330, 340 is preferably fashioned from a material that has sufficient strength to withstand most attempts at removing the panel 320 from the container 300. This material may or may not have magnetic properties. Examples of strong materials that may be used to fashion the locking member 330, 340 include, but are not limited to, iron, ferromagnetic ceramics, aluminum, stainless steel, hard plastics, and the like.

The panel 320 may be provided with a sealant for providing a waterproof seal along the seam generated at the intersection of the panel 320 and the side wall 360. This sealant may be in the form of a silicon sealant member attached to the panel 320 around a perimeter of the panel 320, a sealant being applied in the opening between the side wall 360 and the panel 320 after the panel 320 has been secured in place, or the like, for example.

In one preferred embodiment of the present invention, the container/compartment 300 is a niche of a columbarium that is used to store the cremated remains of a deceased individual or animal. Typically, for human remains, columbaria are constructed with niches having sufficient capacity to store the remains of two individuals, e.g., husband and wife. Since most individuals do not pass away at the same time, it is important to be able to access the niche after placement of one spouse's remains within the niche in order to inurn the second spouse's remains once the second spouse dies.

As a result, the columbarium niche according to the present invention is provided with a concealed ferromagnetic locking mechanism 330, 340 that permits the panel 320 covering the niche opening to be secured after placement of the remains of a first deceased spouse. That is, the panel 320 may be placed over the opening in the niche and the locking mechanisms 330, 340 allowed to roll down the channel 310 to rest in a position within the recess 350 thereby effectively locking the panel 320 to the niche structure, i.e. container/compartment side wall 360.

Once the other spouse passes away, the ferromagnetic locking mechanism 330, 340 of the present invention may be disengaged by using a magnetic key to move the locking mechanism 330, 340 along the channel away from the recess 350. Once the locking mechanism 330, 340 is disengaged from the recess 350, the panel 320 may be removed giving access to the contents of the niche. In this way, the remains of the second spouse may be added to the remains of the first spouse within the interior of the niche.

Thereafter, the ferromagnetic locking mechanism 330, 340 may be removed from the panel and replaced with a similar non-ferromagnetic locking mechanism. That is, the circular disc 330, 340 may be extracted from the channel 310 by way of the slot opening in the side of the panel 320 and non-ferromagnetic locking mechanisms may be placed within the channel 310. Once the panel 320 is put back into place over the opening of the niche, the non-ferromagnetic locking mechanism 330, 340 engages the recess 350 formed in the side wall 360 of the niche since there is nothing causing the non-ferromagnetic locking mechanism 330, 340 to stay in a disengaged state. That is, even if the magnetic key were placed against the outside surface of the panel 320, it still would not attract the non-ferromagnetic locking mechanism 330, 340.

Since the non-ferromagnetic locking mechanism cannot be moved by a magnetic field and there is no other access to the locking mechanism 330, 340 from outside the niche, the use of the non-ferromagnetic locking mechanism essentially forms a permanent lock of the niche. Thus, when it is determined appropriate, the present invention permits a virtually permanent lock of the contents of the niche so that external access to the contents of the niche is prevented without great effort.

This exemplary embodiment of the present invention solves many of the problems of the prior art columbarium niche structures in that individual panels for each niche are made possible without having physical locking mechanisms directly accessible from outside the niche. That is, since individual panels are provided, the problems in the prior art associated with privacy and respect of the contents of other niches in the columbarium are avoided. In addition, engraving of epitaphs, memorial phrases, and the like, on the panels is made easier by making the panels of a size that is relatively easier to handle.

Most importantly, when the panels are in place, there is no discernable mechanism for removing the panels from the niches. Thus, the casual observer will not be aware of how to remove the panel from, and in some cases may not even be aware that a panel is present on, the niche. Moreover, the causal observer will not be able to determine that access to the niche's contents is made possible by using a magnetic key to move the locking mechanisms in order to remove the panel. This is a vast improvement over the externally visible ornamental screw mechanisms typically used in known columbarium structures. With known columbaria, anyone having an adequate tool may gain direct access to the securing mechanisms of the columbarium niches and may remove them to access the contents of the niche.

Figure 4A:
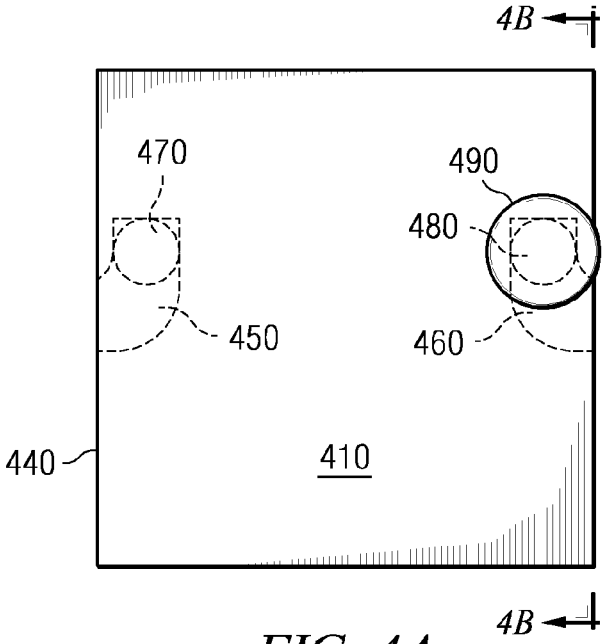
FIG. 4A is an exemplary diagram illustrating a front view of a panel in accordance with one exemplary embodiment of the present invention.
Figure 4B:
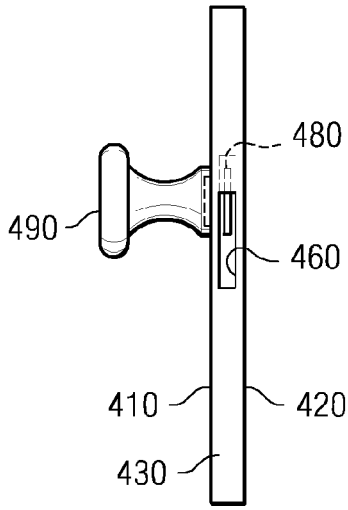
FIG. 4B is an exemplary diagram illustrating a side view of a panel in accordance with one exemplary embodiment of the present invention.

FIGS. 4A and 4B are exemplary diagrams illustrating a front and side view, respectively, of a panel in accordance with one exemplary embodiment of the present invention. As shown in FIGS. 4A and 4B, the panel includes planar surfaces 410 and 420 and edge surfaces 430 and 440. Channels 450 and 460 are formed in the interior of the material forming the panel such that the channels are not perceivable from a viewer whose vantage point is such that he/she views the panel from either of the planar surfaces 410, 420. This is illustrated by the channels being shown as "ghost" lines in FIGS. 4A and 4B.

As shown in the side view of FIG. 4B, the channels 450 and 460 appear to be slots when the panel is viewed from an edge of the panel. Within the channels 450 and 460 are locking members, e.g. discs, 470 and 480. The discs 470 and 480 are permitted to roll down the channels 450 and 460 when not maintained in place by an externally applied magnetic field, such as produced by external magnetic key 490. The discs 470-480 preferably roll down the channels 450 and 460 to rest in a position where the discs 470 and 480 are partially within the channels 450 and 460 and partially within a recess (not shown) formed in a structure of the container/compartment. The container/compartment serves as an enclosure having walls and at least one opening over which the panel may be placed.

In addition, as previously discussed above, the opening or slot formed in the edge of the panel by the channels 450 and 460 may be used to remove the discs 470 and 480 so that they may be replaced with different locking mechanisms. For example, the discs 470 and 480 may be formed from a ferromagnetic material when it is desirable to preserve the option to unlock the container/compartment in order to gain access to the contents. When it is determined that the container/compartment is to be permanently sealed, the ferromagnetic discs may be removed via the slot or opening and replaced with non-ferromagnetic discs. Once these non-ferromagnetic discs engage the recess formed in the container/compartment, the container/compartment is virtually permanently sealed.

As depicted, there are no mechanisms on the planar surfaces 410 and 420 of the panel that permit a human being to move the discs 470 and 480 within the channels 450 and 460. Thus, when in place, the panel does not appear to be removable. Furthermore, there are no perceivable attachment mechanisms that may be manipulated by an unauthorized user, e.g. attachment screws that may be removed by a user having an appropriate tool.

It should further be noted that while the panel and the opening in the container/compartment have been illustrated as having a square or rectangular configuration, the present invention is not limited to such. Rather, any configuration of the panel and/or opening in the container/compartment may be used without departing from the spirit and scope of the present invention. For example, circular, trapezoidal, hexagonal, or other geometrically formed configurations may be utilized without departing from the spirit and scope of the present invention.

Figure 5:
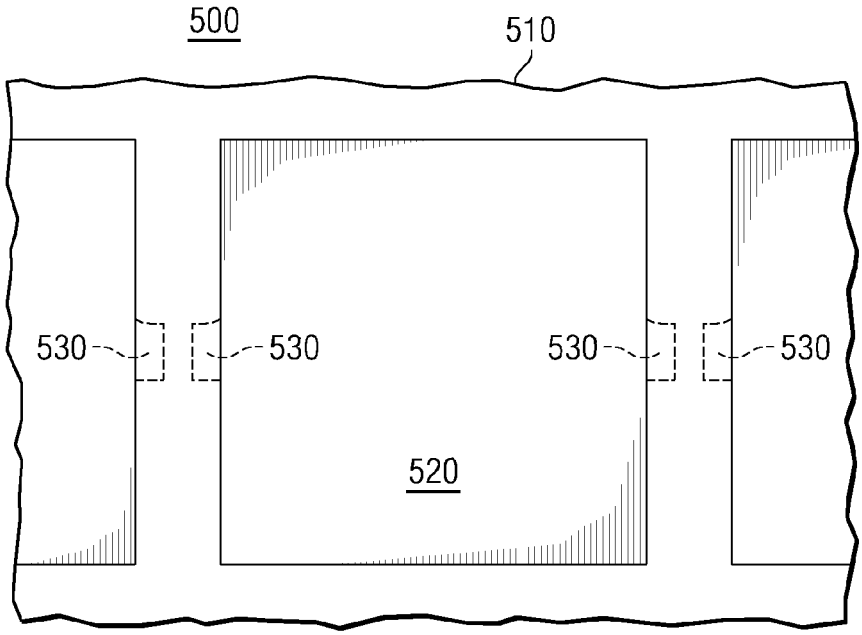
FIG. 5 is an exemplary diagram illustrating a niche structure in a columbarium according to one exemplary embodiment of the present invention.

FIG. 5 is an exemplary diagram illustrating a niche structure in a columbarium according to one exemplary embodiment of the present invention. As shown in FIG. 5, the niche structure 500 includes walls 510 that form an opening 520. In at least one of the walls 510 (although two are shown) recesses 530 are formed so that the locking mechanisms of a panel may engage the niche structure 500. In this way, the panel may be used to enclose the niche and the locking mechanisms may secure the panel to the niche structure 500 to thereby result in a secured enclosure for contents.

The niche structure 500 and the panel may be formed from any suitable material for the particular implementation. In a preferred embodiment, the niche structure 500 and the panel are formed from a stone material, such as marble or granite.

While the above exemplary embodiments illustrate the mechanism of the present invention being used with a niche in a columbarium, it should be appreciated that the present invention is not limited to such. Rather, the mechanisms of the present invention may be applied to any container/compartment. Such a container/compartment may be one of a plurality of niches in a columbarium, as previously discussed above, or may be some other container/compartment, such as a wall mounted compartment, stand-alone container or the like. The container/compartment may be one that is intended to be visible or may be a concealed container/compartment that is meant to blend into the surroundings of the container/compartment. The concealed nature of the locking mechanisms aides in the concealment of the container/compartment as a whole.

Thus, the present invention provides an improved concealed panel locking mechanism for securing the contents of a container/compartment. When used with a niche of a columbarium structure, the present invention provides improvements over known columbarium structures in terms of security and aesthetics.

It should be noted that while the preferred embodiments of the present invention have been described in terms of a locking mechanism having a locking member that engages due to the pull of gravity on the locking member and the resultant inertia, the present invention is not limited to such. To the contrary, any mechanism that forces the locking member to be in an engaged position when not influenced by an outside force, such as the attraction of a magnetic field, may be used without departing from the spirit and scope of the present invention. Thus, for example, a spring loaded mechanism may be provided such that the spring holds the locking member in an engaged position when an external magnetic field is not present. However, when a magnetic field is present, such as due to the placement of a magnetic key on the surface of the panel, the locking member may be moved out of the engaged position against the force exhibited by the spring mechanism. Other embodiments of the present invention may be implemented using other locking members of a similar sort in which the locking member is in an engaged position when not forced from the engaged position by an external force.

The description of the present invention has been presented for purposes of illustration and description, and is not intended to be exhaustive or limited to the invention in the form disclosed. Many modifications and variations will be apparent to those of ordinary skill in the art. The embodiments disclosed herein were chosen and described in order to best explain the principles of the invention, the practical application, and to enable others of ordinary skill in the art to understand the invention for various embodiments with various modifications as are suited to the particular use contemplated.

What is claimed is:

1. An apparatus, comprising:

a panel having two substantially flat planar surfaces;

at least one channel formed in an interior of the panel such that the at least one channel is not visible from either planar surface of the panel;

at least one locking member provided within the at least one channel, wherein the at least one locking member is movable along the at least one channel to be in an engaged or disengaged position, and wherein there are no visible mechanisms on the planar surfaces of the panel by which the at least one locking member is moved within the at least one channel; and a compartment structure, wherein the compartment structure includes at least one recess in at least one side wall of the compartment structure, and wherein the at least one locking member is moved into the engaged position when the at least one locking member engages the at least one recess and is moved into the disengaged position when the at least one locking member disengages from the at least one recess.

2. The apparatus of claim 1, wherein the at least one locking member is formed from a ferromagnetic material, and wherein the at least one locking member is moved along the at least one channel by using a magnetic field to magnetically attract the ferromagnetic material of the at least one locking member.

3. The apparatus of claim 2, further comprising a magnetic key, wherein the magnetic key generates the magnetic field for magnetically attracting the ferromagnetic material of the at least one locking member when the magnetic key is placed on a surface of the panel.

4. The apparatus of claim 1, wherein the at least one channel is a curved channel that has a vertical component and a horizontal component, and wherein the at least one locking member has a circular configuration.

5. The apparatus of claim 4, wherein the curved channel is configured such that, in the absence of an external magnetic field, the at least one locking member rolls down the curved channel due to gravity and comes to rest in the engaged position.

6. The apparatus of claim 1, wherein the compartment structure is a niche in a columbanum.

7. The apparatus of claim 1, wherein:

a non-ferromagnetic locking member of the at least one locking member is formed from a non-ferromagnetic material, when the non-ferromagnetic locking member is in the engaged position, the non-ferromagnetic locking member rests partly in the at least one recess in the at least one wall of the compartment structure, and when the non-ferromagnetic locking member is in the engaged position, the non-ferromagnetic locking member is not movable to the disengaged position.

8. A method comprising:

providing a panel of material having two substantially flat planar surfaces;

forming at least one channel in an interior of the panel such that the at least one channel is not visible from either planar surface of the panel; and providing at least one locking member within the at least one channel, wherein the at least one locking member is movable along the at least one channel to be in an engaged or disengaged position, and wherein there are no visible mechanisms on the planar surfaces of the panel by which the at least one locking member is moved within the at least one channel; and providing a compartment structure, wherein the compartment structure includes at least one recess in at least one side wall of the compartment structure, and wherein the at least one locking member is moved into the engaged position when the at least one locking member engages the at least one recess and is moved into the disengaged position when the at least one locking member disengages from the at least one recess.

9. The method of claim 8, wherein providing the at least one locking member includes forming the at least one locking member from a ferromagnetic material, and placing the at least one locking member such that the at least one locking member is moved along the at least one channel by using a magnetic field to magnetically attract the ferromagnetic material of the at least one locking member.

10. The method of claim 9, further comprising:

providing a magnetic key, wherein the magnetic key generates the magnetic field for magnetically attracting the ferromagnetic material of the at least one locking member when the magnetic key is placed on a surface of the panel.

11. The method of claim 8, wherein forming the at least one channel includes forming the at least one channel as a curved channel that has a vertical component and a horizontal component, and wherein the at least one locking member has a circular configuration.

12. The method of claim 11, wherein the curved channel is configured such that, in the absence of an external magnetic field, the at least one locking member rolls down the curved channel due to gravity and comes to rest in the engaged position.

13. The method of claim 8, wherein the compartment structure is a niche in a columbarium.

14. A columbarium having at least one niche, wherein the at least one niche comprises:

a plurality of walls forming an enclosure with an opening; and a panel having substantially flat planar surfaces, for covering the opening, wherein the panel includes:

at least one channel formed in an interior of the panel such that the at least one channel is not visible from either planar surface of the panel; and at least one locking member provided within the at least one channel, wherein the at least one locking member is movable along the at least one channel to be in an engaged or disengaged position with regard to the enclosure, and wherein there are no visible mechanisms on the planar surfaces of the panel by which the at least one locking member is moved within the at least one channel.

15. The columbarium of claim 14, wherein the at least one locking member is formed from a ferromagnetic material, and wherein the at least one locking member is moved along the at least one channel by using a magnetic field to magnetically attract the ferromagnetic material of the at least one locking member.

16. The columbarium of claim 15, further comprising a magnetic key, wherein the magnetic key generates the magnetic field for magnetically attracting the ferromagnetic material of the at least one locking member when the magnetic key is placed on a surface of the panel.

17. The columbarium of claim 14, wherein the at least one channel is a curved channel that has a vertical component and a horizontal component, and wherein the at least one locking member has a circular configuration.

18. The columbarium of claim 17, wherein the curved channel is configured such that, in the absence of an external magnetic field, the at least one locking member rolls down the curved channel due to gravity and comes to rest in the engaged position.

19. The columbarium of claim 14, wherein the plurality of walls forming the enclosure include at least one recess in at least one wall, and wherein the at least one locking member is moved into the engaged position when the at least one locking member engages the at least one recess and is moved into the disengaged position when the at least one locking member disengages from the at least one recess.

20. The columbarium of claim 14, wherein:

a non-ferromagnetic locking member of the at least one locking member is formed from a non-ferromagnetic material, when the non-ferromagnetic locking member is in the engaged position, the non-ferromagnetic locking member rests partly in an opening in one of the walls of the enclosure, and when the non-ferromagnetic locking member is in the engaged position, the non-ferromagnetic locking member is not movable to the disengaged position.

* * * * *